US005799851A

United States Patent [19]

Wulf et al.

[11] Patent Number: 5,799,851

[45] Date of Patent: Sep. 1, 1998

[54] COMBINED DAY PACK/TRAVEL PACK

[75] Inventors: Katherine Wulf, Vista; Julie Beer, Encinitas, both of Calif.

[73] Assignee: Eagle Creek, Inc., San Marcos, Calif.

[21] Appl. No.: 847,126

[22] Filed: May 1, 1997

Related U.S. Application Data

[60] Provisional application No. 60/023,925, Aug. 14, 1996.

[51] Int. Cl.[6] ..... A45F 3/04

[52] U.S. Cl. ..... 224/583; 224/580; 224/582; 224/623

[58] Field of Search ..... 224/153, 582, 224/583, 580, 577, 623

[56] References Cited

U.S. PATENT DOCUMENTS

| | | | |
|---|---|---|---|
| D. 359,847 | 7/1995 | Callegari . | |
| D. 370,090 | 5/1996 | Coggins . | |
| D. 375,402 | 11/1996 | Yeh . | |
| 3,233,803 | 2/1966 | Gray | 224/153 X |
| 4,066,195 | 1/1978 | Dickler . | |
| 4,318,502 | 3/1982 | Lowe et al. . | |
| 4,368,835 | 1/1983 | Murphy . | |
| 4,524,482 | 6/1985 | Mueller . | |
| 4,563,777 | 1/1986 | Park . | |
| 4,593,841 | 6/1986 | Lange . | |
| 4,655,343 | 4/1987 | Lane et al. | 224/153 X |
| 4,883,207 | 11/1989 | McArthur . | |
| 4,887,751 | 12/1989 | Lehman . | |
| 4,961,522 | 10/1990 | Weber . | |
| 4,995,487 | 2/1991 | Plath . | |
| 5,022,574 | 6/1991 | Cesari . | |
| 5,167,306 | 12/1992 | Carrigan, Jr. . | |
| 5,176,102 | 1/1993 | Tracy . | |
| 5,447,261 | 9/1995 | Mitomi et al. . | |
| 5,544,792 | 8/1996 | Arnwine | 224/153 |
| 5,560,524 | 10/1996 | Brune . | |
| 5,603,441 | 2/1997 | Easter | 224/582 |
| 5,657,917 | 8/1997 | Johnson et al. | 224/582 |

FOREIGN PATENT DOCUMENTS

| | | |
|---|---|---|
| 2454773 | 4/1979 | France . |
| 1238303 | 6/1967 | United Kingdom . |

OTHER PUBLICATIONS

Roma Kids, vol. 72, Jan.–Jun. 1988, p. 169.

*Primary Examiner*—Renee S. Luebke
*Attorney, Agent, or Firm*—Finley & Berg, LLP

[57] ABSTRACT

A combined day pack/travel pack which conveniently converts for use as a single combined unit, a dual combined unit in which the travel pack is worn on the user's back while the day pack rides against the user's front, or two separate units. When used as a single combined unit, the day pack is detachably fixed to the front side of the travel pack. When used as a dual combined unit, snap hooks mounted on the top of the day pack are detachably fixed to D-rings mounted on shoulder straps fixed to the travel pack, such that the user carries the travel pack on the back using the shoulder straps and the day pack is suspended in a position adjacent to the user's chest.

29 Claims, 8 Drawing Sheets

FIG. 2
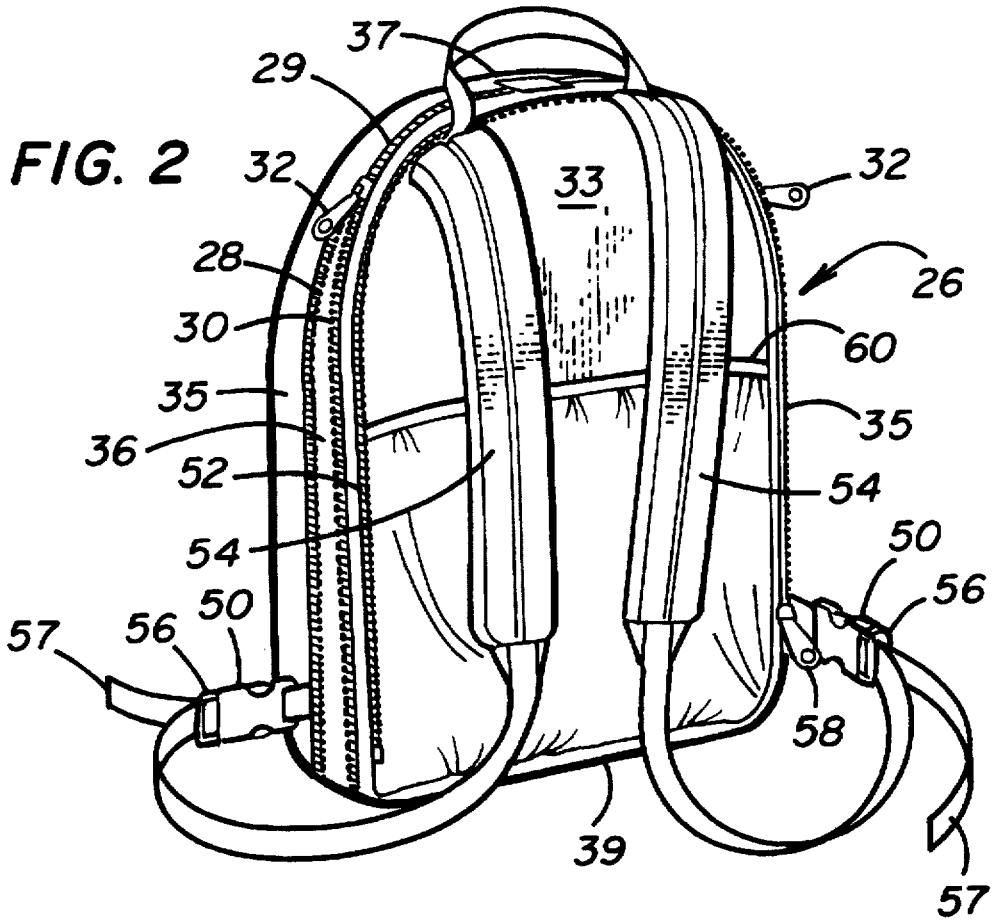
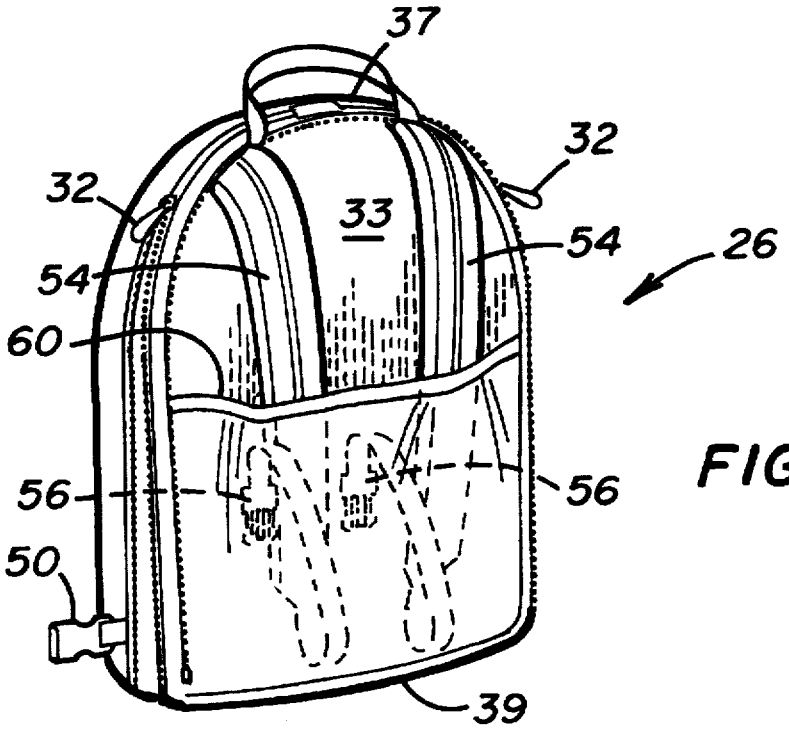
FIG. 2A

COMBINED DAY PACK/TRAVEL PACK

This application replaces provisional application Ser. No. 60/023,925 filed Aug. 14, 1996.

FIELD OF THE INVENTION

This invention relates generally to convertible luggage containers which can be used either as conventional luggage or as travel packs and which have a detachable day pack which can be used separately from the main luggage unit.

BACKGROUND OF THE INVENTION

In recent years, it has become more common for travelers to utilize a travel pack, wherein personal belongings may be carried on one's back in a container that is slung over one's shoulders by means of shoulder straps. This frees one's hands for whatever purpose, but most importantly, provides an easy way to carry a heavy load without putting an undue burden on one's arms. The inconvenience of a backpack type container is that one is denied access to personal papers such as tickets, passports, or travelers checks while the backpack is in use.

Sophisticated travelers using backpacks have resorted to the simple expedient of carrying a day pack to accompany the backpack. This day pack, which is smaller than the backpack and which includes its own shoulder straps, is slung over one's shoulder in reverse manner so that the day pack rides against the chest of the user while the backpack rides against the back.

While this solution has been utilized, it has a serious drawback in that the day pack is not designed to be carried on one's chest, but rather is designed to be carried on one's back, just as the backpack is designed to be carried on the back.

None of the prior art solves this problem by providing a combination backpack and day pack having a day pack which may be attached to the shoulder straps of the backpack so as to allow the backpack to hang freely in front without the use of a second set of shoulder straps.

SUMMARY OF THE INVENTION

It is therefore an object of the present invention to provide a combination day pack and travel pack such that the day pack may be directly affixed to D-rings mounted on the shoulder straps of the travel pack and positioned adjacent to the user's chest.

Another object of the present invention is to provide a day pack which may be compressed or expanded so that the day pack can hold substantial amounts of material when expanded but takes up less space when compressed.

A further object of the present invention is to provide a day pack which protects the user from contact with unused attachments. To achieve this end, the day pack includes a back cover which covers the shoulder straps of the travel pack when not in use and a rear pocket on the day pack which holds the day pack's shoulder straps when not in use, and allows the user to cover the D-rings used to attach the day pack to the front of the travel pack when the day pack is compressed.

A still further object of the present invention is to provide security for the user of the luggage container by providing D-rings proximate to the keepers of the slide fasteners used to open and close the pockets of the day pack and to the slide fastener used to attach the day pack to the travel pack, so that the keepers can be locked to the D-rings to prevent theft.

Another object of the present invention is to provide adjustable shoulder straps on the travel pack such that the position of the shoulder straps on the travel pack is suitable to the user's height.

A further object of the present invention is to provide a cushioned adjustable back pad for the comfort of the user.

Still another object of the present invention is to provide a means to attach a shoulder-carry strap by which the user may carry the luggage over a shoulder.

A further object of the present invention is to provide side tightening buckles on the travel pack for compression of the travel pack.

Yet another object of the present invention is to provide accessible support rods for the travel pack which may be removed from the travel pack and bent to a shape best suited to the particular characteristics of the back of the user.

Other objects and advantages of the present invention will become apparent when the luggage of the present invention is considered in conjunction with the accompanying drawings, specification, and claims.

BRIEF DESCRIPTION OF THE DRAWINGS

FIG. 2 is a back view of the day pack, showing the day pack detached from the travel pack and with shoulder straps ready for use;

FIG. 2A is a back view of the day pack with shoulder straps as stowed in a storage pouch;

DESCRIPTION OF THE PREFERRED EMBODIMENT

Figure 1:
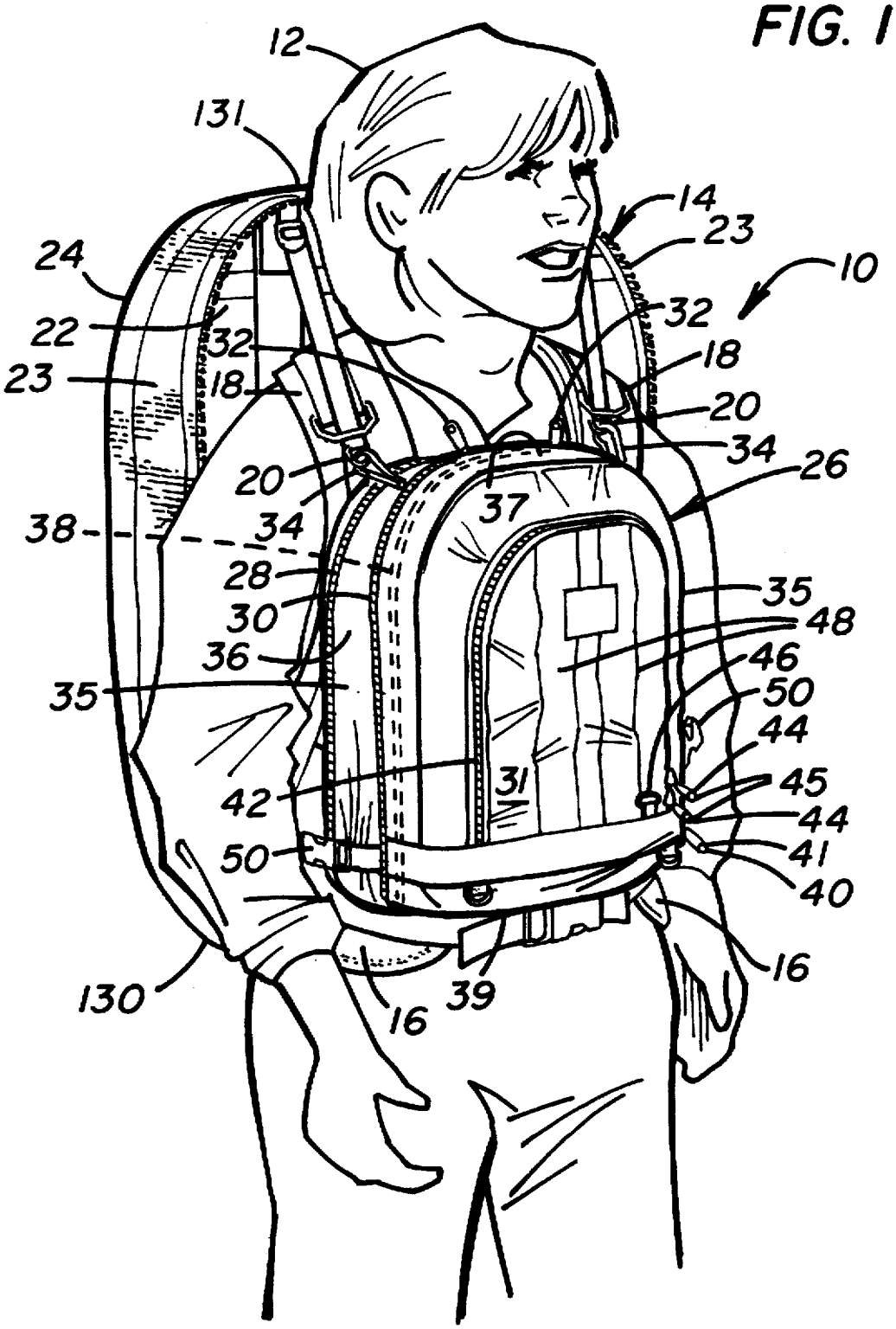
FIG. 1 is a front perspective view showing the combined day pack and travel pack as worn by a user with the travel pack worn on the back over the shoulders and the day pack worn suspended down the user's chest.

FIG. 1 shows the combined day pack and travel pack 10 in use. The combined pack 10 consists of a travel pack 14 and a day pack 26. These may be formed of any convenient durable material such as plastic, vinyl, canvas fabric, nylon, leather, etc. Travel pack 14 defines a front side 24, a back side 22, sides 23, a bottom 130, and a top 131. Similarly, day pack 26 defines a front side 31, a back side 33, sides 35, a top 37, and a bottom 39.

Figure 5:
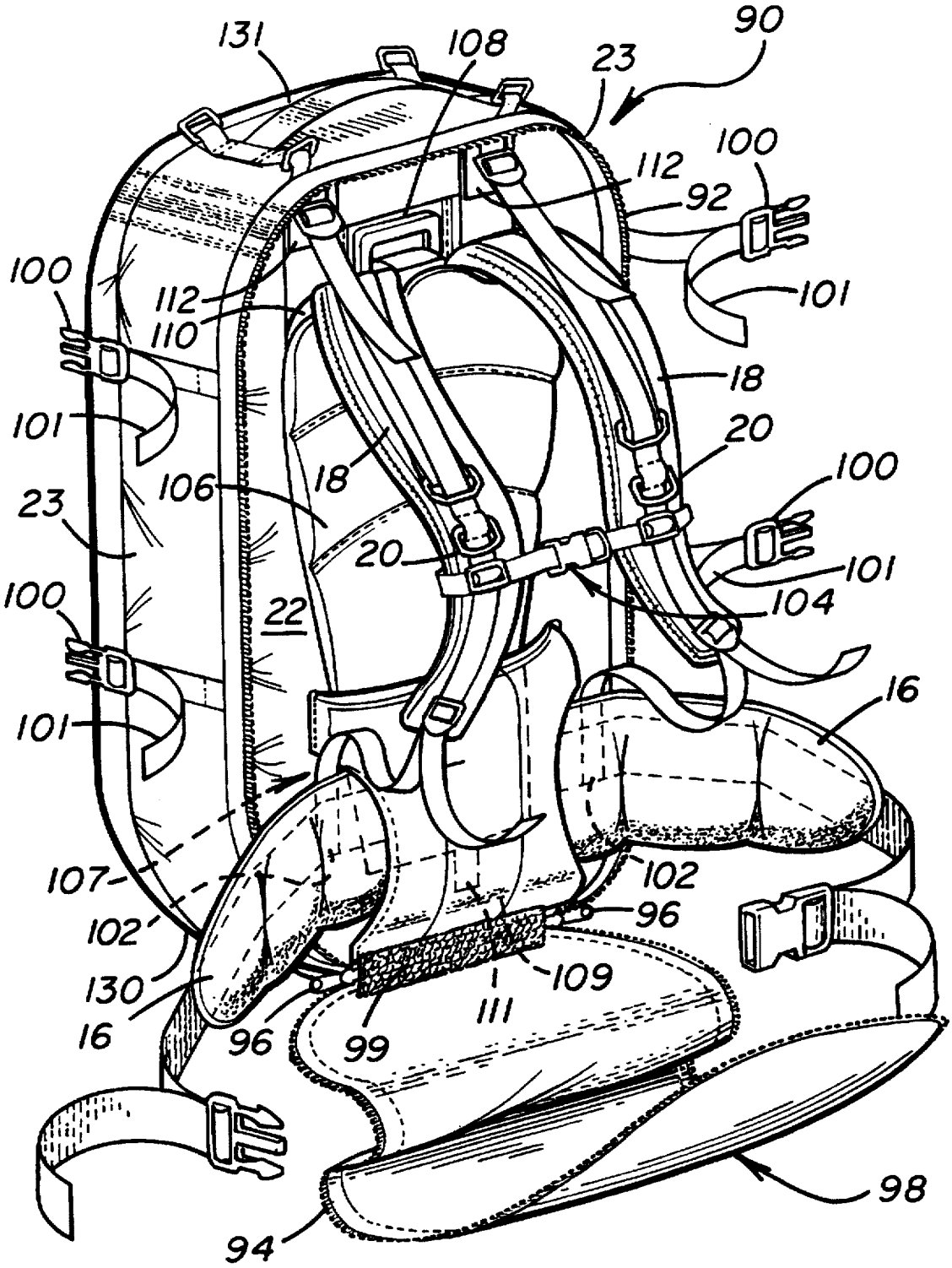
FIG. 5 is a back perspective view of the travel pack, showing a back cover used to enclose the shoulder straps of the travel pack in the open position.

User 12 may wear the travel pack 14 on the back by means of shoulder straps 18 in a conventional manner. A waist strap 16 provides support for the weight of travel pack 14 and prevents unnecessary movement. Referring to FIG. 5, shoulder straps 18 may be connected across the user's chest by means of a sternum strap 104 for relief of stress to the shoulders.

Figure 4:
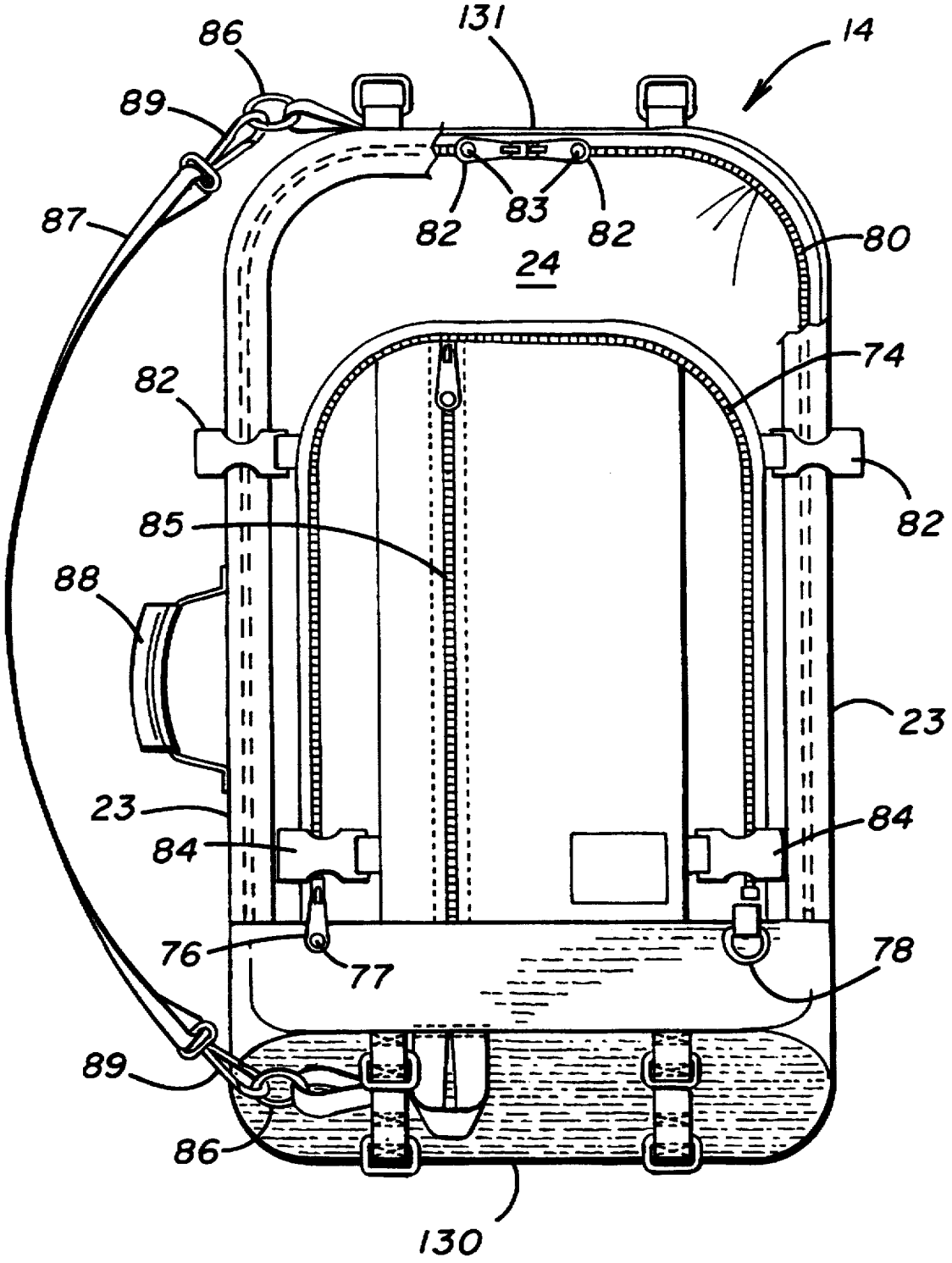
FIG. 4 is a front view of the travel pack, showing the travel pack when the day pack is detached.
Figure 4A:
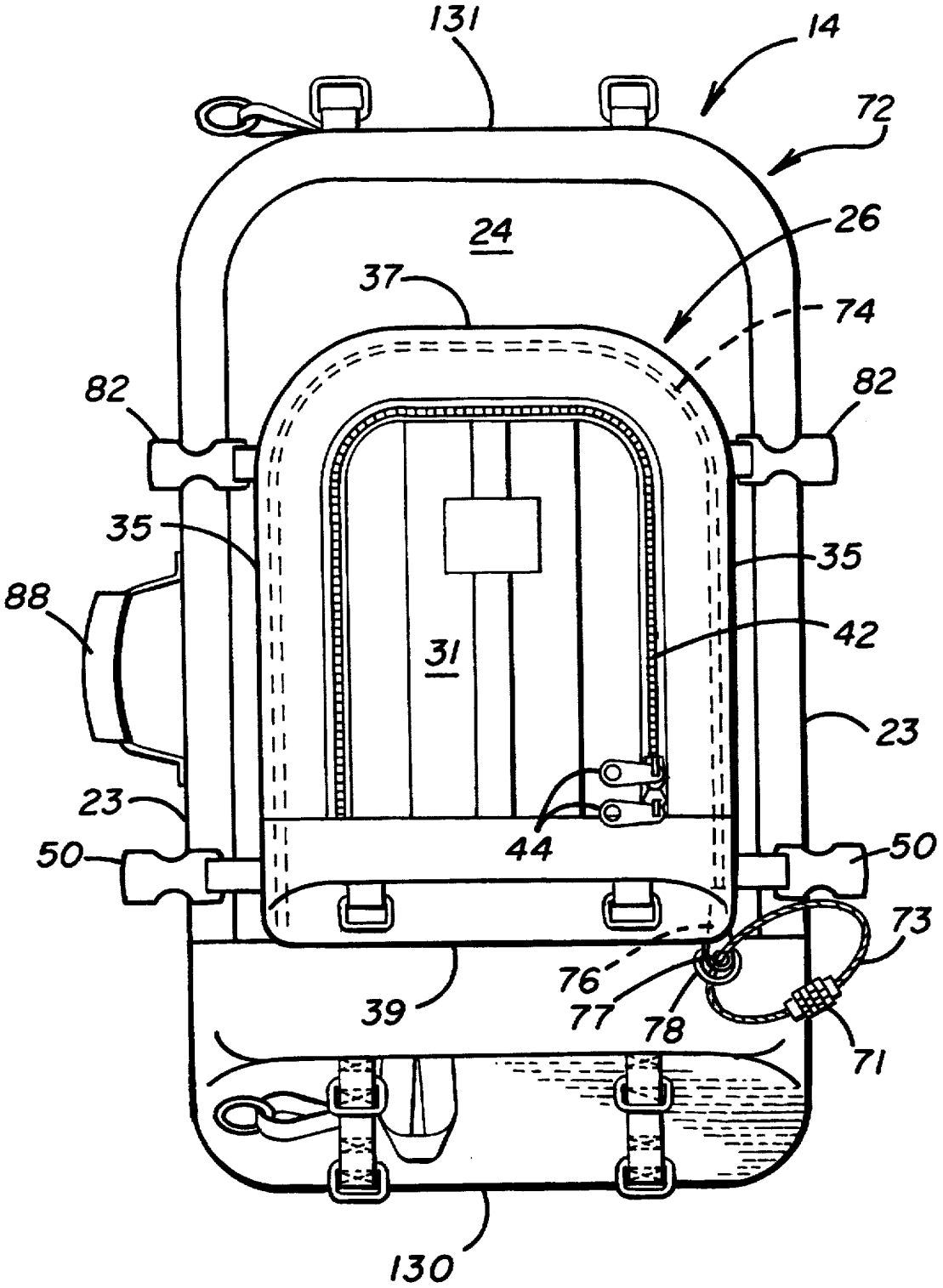
FIG. 4A is a front view of the travel pack with the day pack attached and locked to the travel pack.

As seen in FIG. 4A, day pack 26 may be attached to front side 24 of travel pack 14 as an integral part of travel pack 14, as is well known in the art. In the preferred embodiment, referring to FIGS. 1 and 4, a slide fastener keeper 76 meshes slide fastener teeth 52 on day pack 26 to slide fastener teeth 74 on travel pack 14, thus removably fixing day pack 26 to travel pack 14, as shown in FIG. 4A. A D-ring 78 is attached to travel pack 14 proximate to slide fastener keeper 76 which defines a hole 77 therethrough. A locking device, such as cable 73 with lock 71, may be fed through hole 77 and D-ring 78, allowing user 12 to lock day pack 26 to travel pack 14 to prevent theft. It should be understood that other locking devices capable of fitting through hole 77 and D-ring 78 may also be used.

Referring to FIG. 1, slide fastener 80, which allows user 12 to access the interior of travel pack 14, has a keeper 82 defining a hole 83 therethrough which rests proximate to D-ring 78 when slide fastener 80 is closed. In the manner described above, a locking device (not shown) may be fed through hole 83 and D-ring 78 to secure slide fastener 80 in closed position.

Day pack 26 may also be attached to back side 22 of travel pack 14 so that when combined pack 10 is worn by user 12, day pack 26 hangs down user 12's front side, as shown in FIG. 1. Snap hooks 34 are fixed to the top of day pack 26 on each side, and corresponding D-rings 20 are fixed to shoulder straps 18 of travel pack 14. Snap hooks 34 can be attached to D-rings 20, thus supporting day pack 26 in the front position.

Referring to FIGS. 1 and 2, in the preferred embodiment day pack 26 includes a slide fastener 29 composed of slide fastener teeth 28 and 30 and slide fastener keepers 32. Slide fastener 29 extends around the top, sides, and bottom of day pack 26, and a strip of material 36 is fixed between slide fastener teeth 28 and 30. When slide fastener 29 is closed, as shown in FIG. 2, strip of material 36 folds into interior 61 of day pack 26 underneath slide fastener 29. As the width of slide fastener 29 is less than that of strip of material 36, the width of the sides, top, and bottom of day pack 26 is smaller than when slide fastener 29 is open, thus allowing for a smaller interior volume for day pack 26, providing efficient space usage. When slide fastener 29 is open, as shown in FIG. 1, strip of material 36 may be stretched out in the gap between slide fastener teeth 28 and 30, thus expanding the interior volume of day pack 26 for more storage space.

In the preferred embodiment, snap hooks 34 are attached to strip of material 36. Thus, when slide fastener 29 is open, snap hooks 34 are exposed for use as shown in FIG. 1, and are fully accessible for attachment to D-rings 20. When slide fastener 29 is closed, snap hooks 34 fold under slide fastener 29 enclosed by strip of material 36. In this manner user 12 is protected from contact with snap hooks 34 when day pack 26 is compressed, and snap hooks 34 are protected from exposure when not in use.

Figure 3:
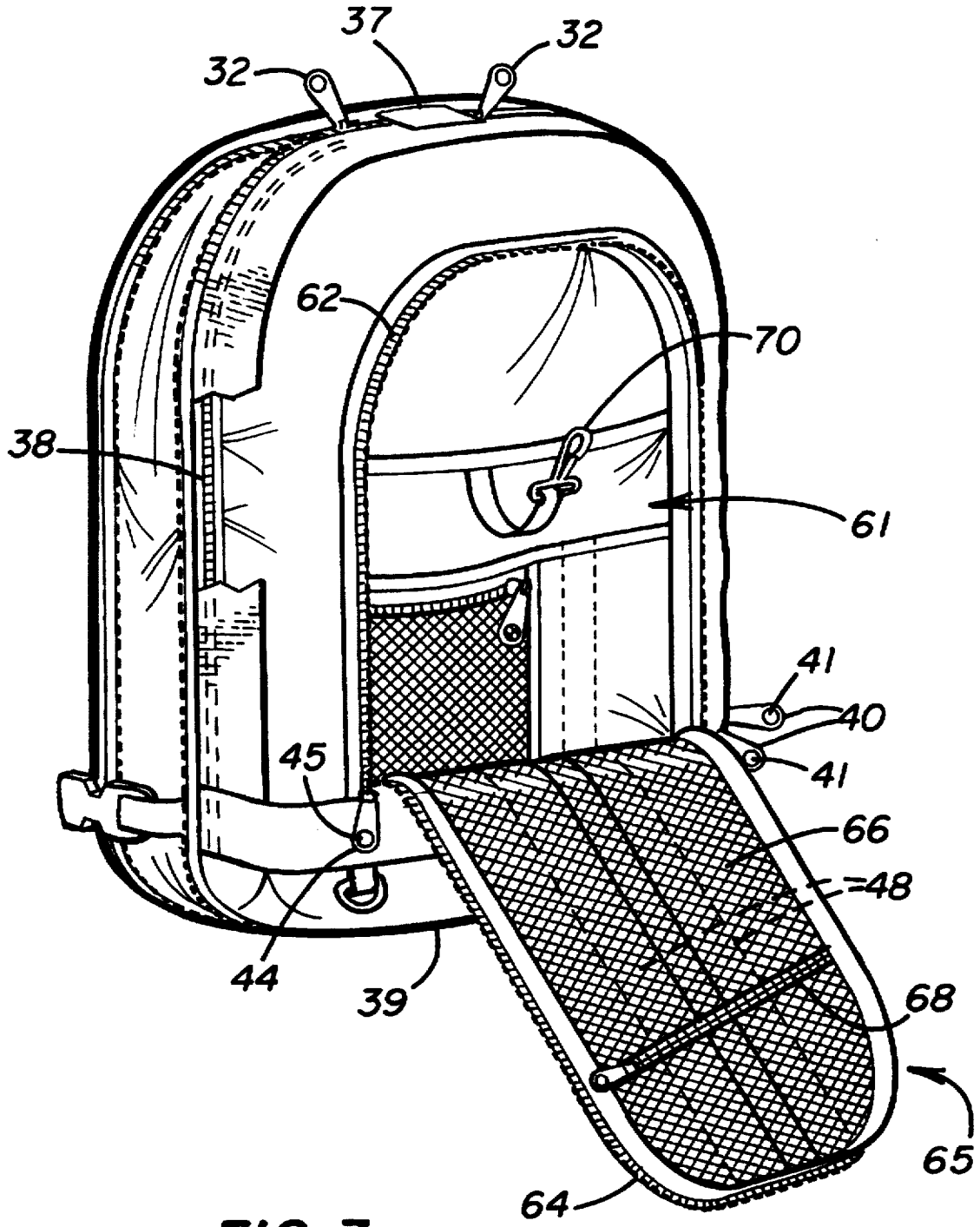
FIG. 3 is a front perspective view of the day pack, showing the interior and front cover of a secondary storage chamber fixed on the front side of the day pack.

Referring to FIGS. 1 and 3, in the preferred embodiment day pack 26 has a main storage chamber which may be accessed by opening slide fastener 38 which has keepers 40. Day pack 26 also has a secondary storage chamber 61 on its front side 31, which may be accessed by opening slide fastener 42 which is composed of outer teeth 62 and inner teeth 64 and has keepers 44. Keepers 40 define holes 41 therethrough, and keepers 44 define holes 45 therethrough. A D-ring 46 is fixed to day pack 26 between and just below the positions of keepers 44 and 40 when slide fasteners 38 and 42 are closed, so that a locking device (not shown) may be fed through holes 41 and D-ring 46 or through holes 45 and D-ring 46 to secure slide fasteners 38 or 42 in closed position.

When slide fastener 42 is open, the front of secondary storage chamber 61 may be pulled away from day pack 26 as a cover panel 65, as shown in FIG. 3. In the preferred embodiment, two flaps 48 extend down the length of cover panel 65, composed of material folded under itself. These folds may be pressed into the surface of cover panel 65, thus extending only minimally outward, or may be stretched out to extend the storage space of secondary storage chamber 61.

In the preferred embodiment, a sheet of webbing 66 is attached to cover panel 65 along teeth 64 of slide fastener 42 and along the fixed attachment of cover panel 65 to day pack 26, forming a pocket between sheet of webbing 66 and the material forming cover panel 65. A slide fastener 68 extends across sheet of webbing 66. Preferably, slide fastener 68 is positioned diagonally across sheet of webbing 66 such that the diagonal orientation increases the length of slide fastener 68, allowing greater access to the pocket. A snap hook 70 is fastened to the interior of secondary storage chamber 61, for securely attaching necessary items such as keys.

Referring to FIG. 2, in the preferred embodiment day pack 26 includes adjustable shoulder straps 54 which are attached to day pack 26 at the upper edge of back side 33. The bottom ends 57 of shoulder straps 54 feed through side release buckle heads 56. Side release buckle heads 56 hold bottom ends 57 in their current position unless bottom ends 57 are directly pulled, allowing the user to adjust the length of the shoulder straps, as is known in the art. As shown in FIGS. 1 and 2, side release buckle clasps 50 are attached to the bottom of front side 31 of day pack 26 proximate to each of sides 35. Side release buckle heads 56 may be attached to side release buckle clasps 50 as shown in FIG. 2, allowing user 12 to wear day pack 26 on the back using shoulder straps 54.

As shown in FIG. 2A, back side 33 of day pack 26 includes a pocket 60 in which shoulder straps 54 may be stored when side release buckle heads 56 are detached from side release buckle clasps 50, protecting user 12 from unnecessary contact with shoulder straps 54 and preventing exposure of shoulder straps 54 when not in use.

As shown in FIG. 4, in the preferred embodiment four side release buckle clasps 82 and 84 are also attached to front side 24 of travel pack 14. Two upper side release buckle clasps 82 are attached proximate the top 131 of travel pack 14 adjacent slide fastener teeth 74 on its outside edge, closer to each of sides 23 of travel pack 14. Two lower side release buckle clasps 84 are attached proximate the bottom 130 of travel pack 14 on each side, adjoining slide fastener teeth 74 on its inside edge, closer to the midline of travel pack 14. Referring to FIG. 5, corresponding adjustable side release buckle heads 100 are attached to travel pack 14 at the juncture between the sides of travel pack 14 and the back side 22 of travel pack 14, at positions proximate to the top and bottom of each side. By attaching side release buckle heads 100 to corresponding side release buckle clasps 82 and 84, and tightening said adjustable heads by pulling straps 101 through buckle heads 100 as is known in the art, user 12 may compress the interior of travel pack 14 to save space and provide greater support for its interior contents.

Because of their respective positioning inside or outside of slide fastener teeth 74, lower side release buckle clasps 84 are hidden by day pack 26 when day pack 26 is fixed to front side 24 of travel pack 14 by slide fastener teeth 74 and 52, while upper side release buckle clasps 82 remain exposed. When day pack 26 is in this position, side release buckle clasps 50 on day pack 26, which are not attached to side release buckle heads 56 because shoulder straps 54 are not in use, may be used in place of side release buckle straps 84 for attachment to side release buckle heads 100. This still enables user 12 to compress travel pack 14 while day pack 26 is fixed to front side 24 of travel pack 14 while providing that neither side release buckle clasps 50 nor 84 are exposed when not in use.

Especially for use in the traditional luggage mode in which cover 98 is in its closed position, travel pack 14 is equipped with a grip handle 88 on one side for carrying travel pack 14 in a horizontal orientation. For further use in this horizontal mode, O-rings 86 are attached to the top and bottom 130 of travel pack 14 proximate to the same side on which grip handle 88 is located. The user may support the luggage over one shoulder by attaching a shoulder strap 87 to the luggage by fastening snap hooks 89 fixed to both ends of shoulder strap 87 to O-rings 86.

Figure 6:
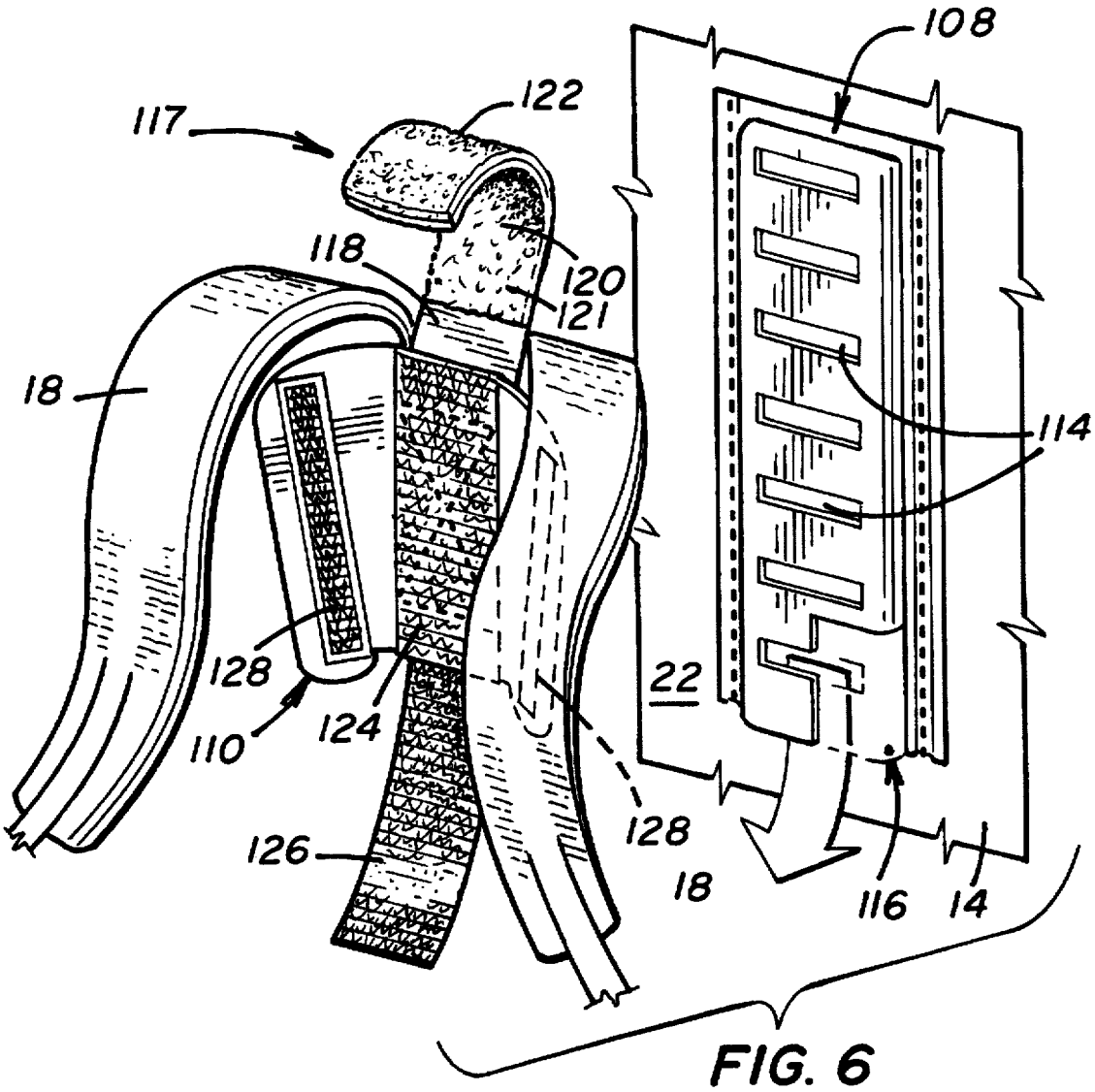
FIG. 6 is a fragmentary partially separated front view of the shoulder strap harness of the travel pack pulled away from the travel pack and the shoulder strap harness fastener attached to the back side of the travel pack.

Referring to FIG. 5, in the preferred embodiment shoulder straps 18 are fixed to back side 22 of travel pack 14 at their bottom ends behind waist strap 16 at points 102. The upper ends of shoulder straps 18 are fixed to a shoulder strap harness 110, shown more clearly in FIG. 6.

Back side 22 comprises a shoulder strap harness fastener 108 forming a plurality of apertures 114 and a groove 116 extending from the bottom of harness fastener 108 and under apertures 114. A strap 117 has a plain section 118 and a fabric eye section 121 having sections of fabric eye material on both sides 120 and 122. One end of plain section 118 is attached to the top of harness 110 and the other end is attached to fabric eye section 121. Strap 117 may be fed through one of the apertures 114 and out another aperture 114 to attach harness 110 to harness fastener 108. Upper side 120 of fabric eye section 121 attaches to fabric hook section 124, and a strap 126 with a fabric hook section on the side facing shoulder strap harness 110 closes over lower side 122 of fabric eye section 121 to secure the harness attachment. By moving the strap 117 to a different set of apertures, the shoulder strap harness 110 and thus the position of the shoulder straps 18 may be easily changed by user 112 to adjust the position of travel pack 14 to user 12's height.

Referring to FIG. 5, in the preferred embodiment a cushioning pad 106 for providing extra comfort to user 12 is attached to the back side 22 of travel pack 14 by strap 111 behind waist strap 16. Two fabric eye strips (not shown) run in parallel down the upper part of the back side of cushioning pad 106 which may be fastened to fabric hook strips 128 on shoulder strap harness 110, shown in FIG. 6, to secure cushioning pad 106 in place.

Referring back to FIG. 5, waist strap 16 is fastened to the back side 22 along edge 109, shown in phantom, forming a pouch 107 into which cushioning pad 106 fits. The height of pouch 107 is sufficient to give enough leeway to hold cushioning pad 106 even when shoulder strap harness 110 is fastened to shoulder strap harness fastener 108 in a low position.

In the preferred embodiment, back side 22 of travel pack 14 is equipped with a cover 98 which may be used to conceal the entire shoulder pad and waist strap assembly for use of the travel pack in a conventional luggage arrangement. Slide fastener teeth 94 extend around the outer edge of cover 98, which is attached to the bottom edge of back side 22 formed by the juncture of back side 22 and the bottom 130 of travel pack 14. Corresponding slide fastener teeth 92 extend around the sides and top of back side 22 and behind the extended arms of waist strap 16, as shown in FIG. 5. By closing the slide fastener formed by slide fastener teeth 92 and 94, as for example by using keepers 96, shoulder straps 18 and waist strap 16 are concealed by cover 98.

Figure 7:
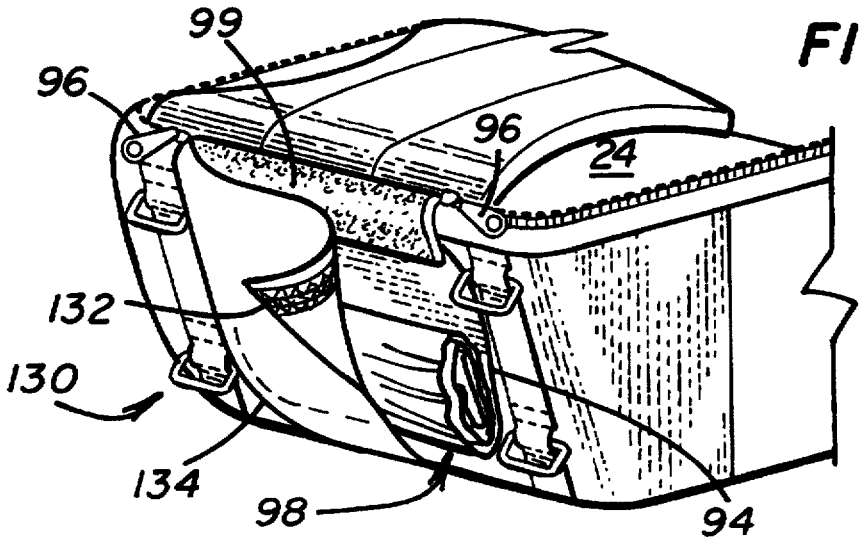
FIG. 7 is a perspective view of the bottom of the travel pack, showing the back cover when opened, rolled, and stored in a storage pouch formed on the bottom of the travel pack.

Referring to FIG. 7, when the slide fastener formed by slide fastener teeth 92 and 94 is open, cover 98 is stored in pouch 134, which is located on the bottom 130 of travel pack 14. Pouch 134 has one open edge 132 adjoining the attachment of cover 98 to back side 22. The side of edge 132 facing the interior of pouch 134 is covered with a fabric hook section, which may be fastened to a fabric eye section 99 at the base of cover 98 when the cover is stored in the pouch, or to a fabric eye section (not shown) on the edge of bottom 130 corresponding to edge 132 when the cover is in use.

Figure 8:
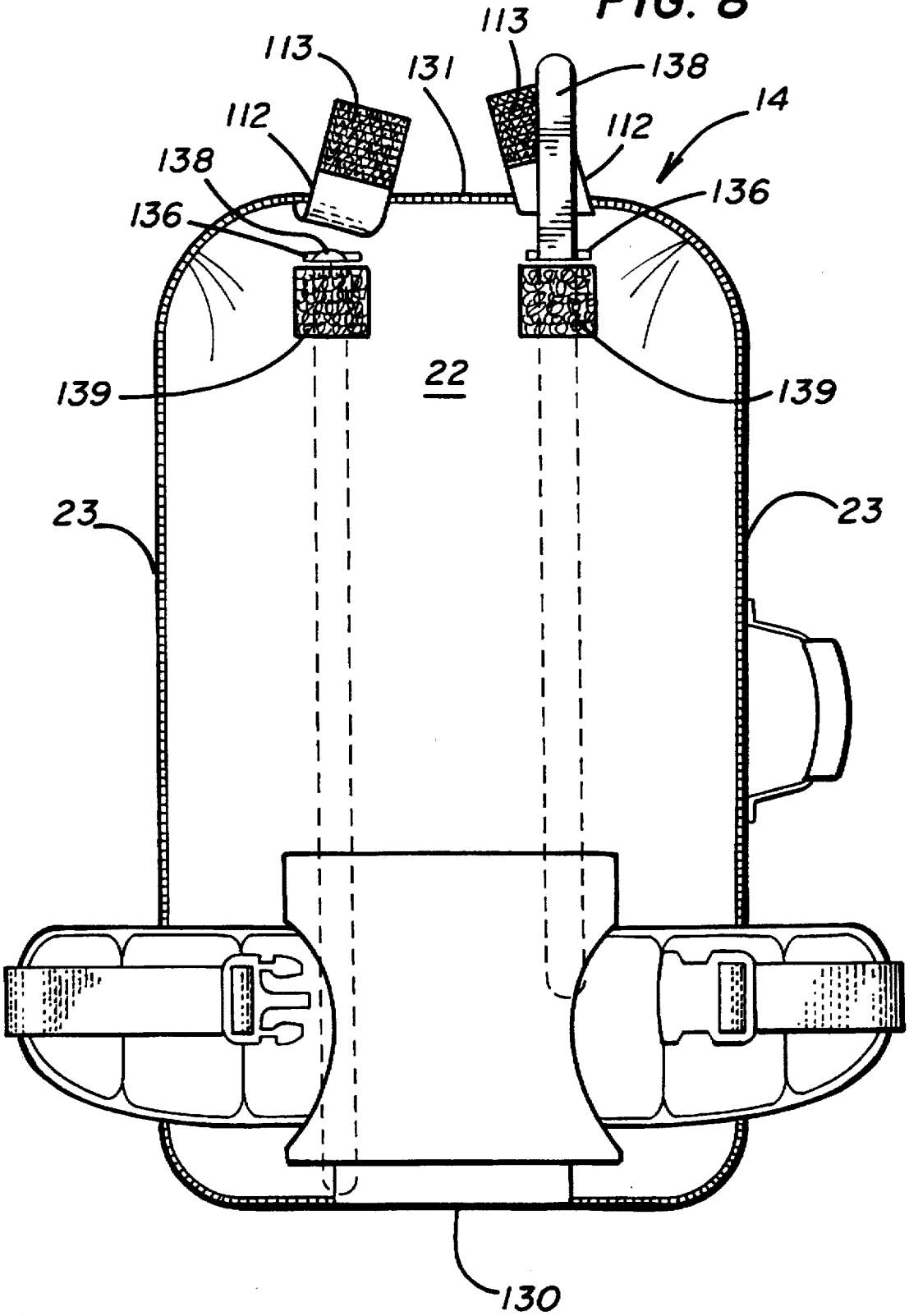
FIG. 8 is a back perspective view of the travel pack, showing the support rods enclosed within the back side of the travel pack and the access points to the support rods in an open position.

Referring to FIG. 8, in the preferred embodiment frame rods 138 extend along the length of travel pack 14 parallel to the sides of travel pack 14. Covering flaps 112 attached to back side 22 proximate the top and each side, as shown in FIGS. 5 and 8, may be lifted to reveal access points 136, from which frame rods 138 may be taken out or reinserted. This allows user 12 to remove frame rods 138, bend them to conform to the shape of user 12's back, and reinsert them. Each cover flap 112 may also be detachably fastened over its corresponding access point 136 by mating a fabric hook section 139 adjoining below access point 136 with a fabric eye section 113 positioned on the inner side of cover flap 112.

Throughout this application reference is made to the use of slide fasteners and fabric hook and eye fasteners as fastening devices. It will be understood by those skilled in the art that zippers, pinch locks similar to enclosures on zip-lock bags, and the like may be used interchangeably as slide fasteners, and that the term fabric hook and eye fastener includes devices such as Velcro®, snaps, and hook and loop combinations.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A luggage container comprising:

a main compartment having a front side, a back side, a top, a bottom, a first side, and a second side, said back side having an upper portion, a bottom left portion, and a bottom right portion;

a day pack having a front side, a back side, a top, a bottom, a right side, and a left side;

a first detachable fastening means for detachably affixing said day pack to said front side of said main compartment;

a shoulder strap harness detachably affixed to said upper portion of said main compartment, having a right side and a left side;

a first adjustable shoulder strap with a first upper end affixed to said left side of said shoulder strap harness and a first lower end affixed to said bottom left portion of said back side of said main compartment, and a second adjustable shoulder strap with a second upper end affixed to said right side of said shoulder strap harness and a second lower end affixed to said bottom right portion of said back side of said main compartment, such that said shoulder straps allow a user to carry the main compartment on the user's back;

a first swiveled snap hook fixed to said top of said day pack adjacent said first side, and a second swiveled snap hook fixed to said top of said day pack adjacent said second side; and a first D-ring fixed to said first adjustable shoulder strap proximate said first upper end, and a second D-ring fixed to said second adjustable shoulder strap proximate said second upper end, such that said day pack may be detachably affixed to said shoulder straps by connecting said first and second swiveled snap hooks to said first and second D-rings.

2. The luggage container of claim 1, wherein said day pack defines a main storage chamber having an interior, a front side and a first outer periphery.

3. The luggage container of claim 2, wherein said day pack further comprises a first slide fastener positioned on said day pack to extend around said first outer periphery, said first slide fastener having an open and a closed position.

4. The luggage container of claim 3, wherein said day pack further comprises a strip of material having a width fastened between said tracks of said first slide fastener, such that said main storage chamber has a first volume when said first slide fastener is in said closed position, and said main storage chamber has a second volume greater than said first volume when said first slide fastener is in said open position, such change in volume corresponding to said width of said strip of material.

5. The luggage container of claim 4, wherein said first and second swiveled snap hooks are attached to said strip of material, such that when said first slide fastener is in said closed position said snap hooks are covered by said first slide fastener and when said first slide fastener is in said open position said snap hooks are fully accessible.

6. The luggage container of claim 1, wherein said day pack further comprises a secondary storage chamber having an interior, a back side, a front side, a right side, a left side, a top, and a bottom, and which is affixed to said front side of said day pack such that said back side of said secondary storage chamber is said front side of said day pack.

7. The luggage container of claim 6, wherein said day pack further comprises a second slide fastener fixed to said secondary storage chamber such that said second slide fastener extends from said left side to said top to said right side of said secondary storage pouch proximate to said front of said secondary storage pouch, said second slide fastener having an open position which defines a front cover and allows a user to access said interior of said secondary storage chamber.

8. The luggage container of claim 7, wherein said second slide fastener further comprises a first end, a second end, and a first keeper defining a hole therethrough, wherein said first keeper rests at said first end of said second slide fastener when said second slide fastener is open and rests at said second end of said second slide fastener when said second slide fastener is closed, and wherein said day pack further comprises a third D-ring fixed to said front side of said secondary storage pouch proximate to said second end of said second slide fastener, such that a standard lock may be fitted through said hole of said first keeper and through said third D-ring such that said second slide fastener cannot be opened.

9. The luggage container of claim 7, wherein said front cover of said secondary storage chamber comprises an exterior side exposed to the environment surrounding said day pack and an interior side exposed to said interior of said secondary storage chamber, said interior side having a second periphery, and further comprising a webbing cover attached at said second periphery to said interior side of said front cover, such that said webbing cover forms a third storage chamber within said interior of said secondary storage chamber.

10. The luggage container of claim 9, further comprising a third slide fastener positioned across said webbing cover, such that said third slide fastener provides access to said third storage chamber.

11. The luggage container of claim 6, wherein said front side of said secondary storage chamber comprises a first material panel defining two flaps aligned in parallel with said sides of said secondary storage pouch and extending from the juncture of said top and said front side of said secondary storage pouch to the juncture of said bottom and said front side of said secondary storage pouch, such that said flaps may either be flattened against said day pack for space conservation or stretched out to expand said interior of said secondary storage pouch.

12. The luggage container of claim 6, further comprising a third snap hook attached to said back side of said secondary storage chamber extending into said interior of said secondary storage chamber.

13. The luggage container of claim 1, wherein said day pack comprises a right side release adjustable buckle clasp attached to the juncture of said front side and said right side adjacent said bottom of said day pack, a left side release adjustable buckle clasp attached to the juncture of said front side and said left side adjacent said bottom of said day pack, a third adjustable shoulder strap with a top end attached to the juncture of said top and said back side adjacent said right side of said day pack and a bottom end forming a right side release buckle head, and a fourth adjustable shoulder strap with a top end attached to the juncture of said top and said back side adjacent said left side of said day pack and a bottom end forming a left side release buckle head, such that said side release buckle heads may be attached to said side release buckle clasps allowing said user to carry said day pack on said user's back.

14. The luggage container of claim 13, wherein said front side of said main compartment has an upper right corner and an upper left corner, and further comprising four adjustable side release buckle clasps fixed to said front side of said main compartment, consisting of an upper right side release buckle clasp proximate to said upper right corner and adjacent said fourth slide fastener on the right, an upper left side release buckle clasp proximate to said upper left corner and adjacent said fourth slide fastener on the left, a lower right side release buckle clasp adjacent said first end of said fourth slide fastener on the left, and a lower left side release buckle clasp adjacent said second end of said fourth slide fastener on the right, and four adjustable side release buckle heads fixed to said right and left sides of said main compartment adjoining said back of said main compartment, consisting of an upper right side release buckle head on said right side proximate to said top of said main compartment, an upper left side release buckle head on said left side proximate to said top of said main compartment, a lower right side release buckle head on said right side proximate to said bottom of said main compartment, and a lower left side release buckle head on said left side proximate to said bottom of said main compartment, such that said side release buckle clasps may be detachably fixed to said side release buckle heads and tightened to compress said luggage container, and such that when said day pack is detachably attached to said front side of said main compartment, said day pack covers said lower right side release buckle clasp and said lower left side release buckle clasp and said side release buckle clasps on said day pack may be used in place of said covered side release buckle clasps.

15. The luggage container of claim 1 wherein said first detachable fastening means comprises a fourth slide fastener positioned on said front side of said main compartment.

16. The luggage container of claim 15 wherein said fourth slide fastener comprises a first end, a second end, and a second keeper defining a hole therethrough, wherein said second keeper rests at said first end of said fourth slide fastener when said fourth slide fastener is open and rests at said second end of said fourth slide fastener when said fourth slide fastener is closed, and wherein said main compartment further comprises a fourth D-ring fixed to said front side of said main compartment proximate to said second end of said fourth slide fastener, such that a standard lock may be fitted through said hole of said second keeper and through said fourth D-ring such that said fourth slide fastener cannot be opened.

17. The luggage container of claim 1 wherein said main compartment comprises a first compartment having a back side and a front side, and a second compartment affixed to said back side of said first compartment, such that said front side of said first compartment is said front side of said main compartment, and said back side of said second compartment is said back side of said main compartment.

18. The luggage container of claim 17 further comprising a main compartment back cover having an open and a closed position, such that said main compartment back cover provides access to said second compartment when in said open position and said main compartment back cover encloses said second compartment when in said closed position.

19. The luggage container of claim 18 wherein said shoulder straps are positioned in and deployable from the interior of said second compartment.

20. The luggage container of claim 18 wherein said main compartment back cover is attached to said main compartment along a back cover edge formed by the juncture of said back side and said bottom of said main compartment, and further comprising a second material panel having an outer edge, where said material panel is attached to said bottom of said main compartment along all of said outer edge except where said outer edge abuts said back cover edge, such that said material panel forms a pouch in which said user may store said cover when said cover is in said open position.

21. The luggage container of claim 1 wherein said back side of said main compartment further comprises a shoulder strap harness fastener defining a plurality of apertures spaced vertically down said back of said main compartment, and wherein said shoulder strap harness further comprises a fastening strap, such that said fastening strap may be detachably fastened to any one of said plurality of apertures, allowing said shoulder strap harness to be effectively raised or lowered relative to the main compartment by changing the level at which said shoulder strap harness is fastened to said shoulder strap harness fastener.

22. The luggage container of claim 1, further comprising a flexible cushioning back pad detachably attached to said shoulder strap harness.

23. The luggage container of claim 1 further comprising a first O-ring attached to said main compartment at the juncture between said top and said right side of said main compartment, and a second O-ring attached to said main compartment at the midpoint of the juncture between said bottom and said right side of said main compartment, such that said user may detachably attach a shoulder-carry strap to said O-rings and thus carry said luggage container by placing said shoulder-carry strap over the shoulder.

24. The luggage container of claim 23 wherein said right side of said main compartment comprises a center, further comprising a luggage handle fixed to said main compartment at said center of said right side of said main compartment.

25. The luggage container of claim 1 further comprising two support rods enclosed within said back side of said main compartment oriented in parallel with said sides of said main compartment, one proximate to said right side of said main compartment, the other proximate to said left side of said main compartment, each support rod having a length, wherein said sides of said main compartment have a length slightly greater than said length of said support rods.

26. The luggage container of claim 25 wherein said back side of said main compartment defines two access points, one access point formed proximate to said top and said right side of said main compartment, and the other formed proximate to said top and said left side of said main compartment, each access point having an open and a closed position, such that when said access points are in said open positions, said user may remove said support rods from or insert said support rods into said back side of said main compartment.

27. The luggage container of claim 1 wherein said back side of said main compartment further comprises a waist support extending across from said bottom left portion to said bottom right portion of said back side of said main compartment, said waist support having a right side and a left side.

28. The luggage container of claim 27 wherein said first lower end of said first adjustable shoulder strap is affixed to said left side of said waist support, and said second lower end of said second adjustable shoulder strap is affixed to said right side of said waist support.

29. The luggage container of claim 28 wherein said waist support comprises a back portion having an upper edge, a lower edge, and two side edges, and wherein said waist support is fixed to said back side of said main compartment only along said lower edge and said side edges of said back side of said waist support, such that said back side of said waist support forms a waist support pocket with said back side of said main compartment which is accessible along said upper edge of said back side of said waist support.

* * * * *